US006174274B1

(12) United States Patent
Hawkins et al.

(10) Patent No.: US 6,174,274 B1
(45) **Date of Patent: *Jan. 16, 2001**

(54) METHOD AND APPARATUS FOR CREATING PREFORMED BONDED PULL TABS OVER A RESEAL LINER

(75) Inventors: Ronnie Lee Hawkins; William R. Weinert, both of Evansville, IN (US)

(73) Assignee: Rexam Plastics, Inc., Evansville, IN (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/999,596

(22) Filed: Oct. 8, 1997

(51) Int. Cl.[7] ..... B31B 1/60

(52) U.S. Cl. ..... 493/77; 53/133.7; 493/75; 493/80; 493/81; 493/110; 493/346; 493/357; 493/363; 493/963

(58) Field of Search ..... 493/75, 76, 77, 493/79, 80, 81, 110, 346, 345, 344, 353, 357, 362, 363, 963; 53/133.7; 215/232, 347

(56) References Cited

U.S. PATENT DOCUMENTS

| | | | | |
|---|---|---|---|---|
| Re. 33,886 | * | 4/1992 | Ullman et al. | 493/77 |
| 3,656,273 | * | 4/1972 | Anderson et al. | 53/133.7 |
| 4,410,089 | * | 10/1983 | Bortolani | 493/79 |
| 4,526,562 | * | 7/1985 | Knudsen et al. | 493/76 |
| 4,610,649 | * | 9/1986 | Friess | 493/11 |
| 4,676,047 | * | 6/1987 | Mutoh | 493/963 |
| 4,822,326 | * | 4/1989 | Ullman et al. | 493/77 |
| 5,062,340 | * | 11/1991 | Greven | 493/344 |
| 5,108,356 | * | 4/1992 | Rickenbach | 493/353 |
| 5,797,509 | * | 8/1998 | Fitch | 215/232 |

* cited by examiner

*Primary Examiner*—Peter Vo
*Assistant Examiner*—Christopher Harmon
(74) *Attorney, Agent, or Firm*—John F. Salazar; Thomas B. McGurk; Middleton & Reutlinger

(57) ABSTRACT

A method and apparatus for formation of a preformed bonded pull tab over a reseal liner is disclosed. The pull tab seal layer of material is bonded together with a reseal liner layer of material for insertion into a closure. The pull tab on the pull tab liner seal is formed prior to combination of the two layers and is folded backwards between the two layers of material. Thus, after combining the two layers, punching out the closure liner and insertion into the closure, the reseal liner is separated from the pull tab seal and the pull tab seal is adhered to the rim of the container. Only one punch press step is required for forming the closure and container seals and insertion of the members into the closure. By forming the pull tab prior to combining the two layers, an assembly of the pull tab and reseal liner is made more efficient and less time consuming.

8 Claims, 3 Drawing Sheets

METHOD AND APPARATUS FOR CREATING PREFORMED BONDED PULL TABS OVER A RESEAL LINER

BACKGROUND OF THE INVENTION

1. Field of the Invention

This present invention relates to manufacturing reseal and pull tab liners which are combined in a closure and which have a pull tab for removing, upon first use, a liner adhered to the container. These types of reseal liners are manufactured and placed in the interior of a closure which is either threadably attached to a container or is snap fitted on the container neck. The pull tab liner is adhered to the rim of the container mouth and is removed by the user upon first use of the container contents. There is also a gasket or reseal liner placed in the interior of the closure to properly seal the container after removal of the pull tab liner.

2. Discussion of the Prior Art

Pull tab reseal liners are fairly well known in the container and closure arts. Historically, these reseal liners are cut out of a web of material and inserted into the closure. A pull tab seal is then prepared, cut out and inserted into the closure which is then threadably screwed onto the container neck. There are many drawbacks however to the prior art manufacturing methods for generating reseal liners and pull tab liners which are adhered to the mouth or rim of a container. First and foremost, since the combined inserted liner is made of multiple layers of varying materials, multiple steps have historically been required for assembly and insertion of the pull tab liner and closure reseal liner into the closure. Additionally, these manufacturing problems have resulted in the layers of the sealing liner material being mis-aligned within the closure and possibly causing the pull tab to be improperly placed along the threads of the container lessening the accessibility of the pull tab for the user.

U.S. Pat. No. 4,754,890 to Ullman et al teaches a tamper evident safety seal which is formed from a sealing liner having an integral tab portion and having a tab being double folded for release of the pull tab liner. The sealing liner for the Ullman reference combines a layer of foil and foam causing the foil to be folded over one edge and then mated with the foam before punching out the liner into the closure. However, one drawback in the tamper evident safety seal taught therein is that the fold over portion of the liner results in a large section of wasted material as opposed to utilizing only a small pull tab, as is used in most removable pull tab and reseal liner combinations. Additionally, the large section of fold over liner material can prevent the closure from sealing properly on the neck of the container before the fold over seal liner is removed thereby impeding the closure from threading onto the container completely or preventing an adequate seal of the container.

There are additional methods of forming a pull tab reseal liner comprised of a first section of wax paperboard overlaid by a separate section of aluminum foil and plastic or seal material, the paperboard acting as the liner in the closure and the aluminum foil and other seal material acting as the pull tab seal liner on the container. These systems, however, such as is shown in U.S. Pat. No. 5,261,990 require the wax paperboard to be punched into the die containing the closure, and in a separate process the pull tab and liner material is separately formed and stamped into the closure for later bonding to the container rim after attachment of the closure on the container. The first layer of paperboard is glued into position against the top wall in the closure above the threads. The pull tab and liner material is then forcibly inserted and frictionally held into place by the threads until later bonding to the container. However, in this embodiment, accurate positioning of the liner material within the cap and of the pull tab is difficult because the separate layers are not combined and pressed into the closure concurrently causing positioning problems with the layers and other assembly difficulties.

SUMMARY OF THE INVENTION

It is therefore an object of the present invention to overcome the deficiencies of the prior art listed above.

It is another object of the present invention to provide a preformed bonded pull tab over a reseal liner which can be constructed in a single manufacturing step thereby preventing separate insertions of liner material into the closure.

It is an additional object of the present invention to form pull tabs on a sealing liner which can be accurately placed and positioned for the user to remove the liner from the container and which prevents the pull tab from being folded under the liner material or being creased along the threads of the container.

It is a further object of the present invention to provide an improved method and apparatus for construction of a preformed bonded pull tab which efficiently utilizes the lining material with limited waste and which can feed a combined paperboard and pull tab liner sheet of material through a standard lining machine for punching into a closure.

Finally, the present invention comprises a method for manufacturing a bonded pull tab over a reseal liner for a closure, comprising: forming pull tabs in a pull tab liner web of material; folding said pull tabs backwards and underneath said pull tab liner web; forming a bonded pull tab over a reseal liner by joining said pull tab liner web with a reseal liner web such that said pull tab is compressed therebetween; punching out into a closure said combined seals. Additionally, the present invention comprises an apparatus for manufacturing a bonded pull tab over a reseal liner, comprising; a web of reseal liner material; a web of pull tab seal material; a tab forming punch press, said web of pull tab seal material positioned below said punch press, said punch press further having at least one tab forming anvil extending downward therefrom and reciprocating through said web of pull tab seal material and forming at least one pull tab therein; means to fold said at least one pull tab backward against said web of pull tab seal material; a radiant heater to bond said web of pull tab seal material and said web of reseal liner material to form a combined web of material such that said at least one pull tab is compressed between said web of pull tab material and said reseal liner material; and a punch press for cutting out said combined web of material. Finally, the present invention creates a web of bonded pull tab over a reseal liner material, comprising: a layer of pull tab liner material, said material having a pull tab formed therethrough; a layer of reseal liner material; wherein said pull tab is compressed between said layer of pull tab liner material and said layer of reseal liner material.

These and other objects and the nature and advantages of the instant invention will be more apparent from the following detailed description of various embodiments of the invention taken in conjunction with the included drawings.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
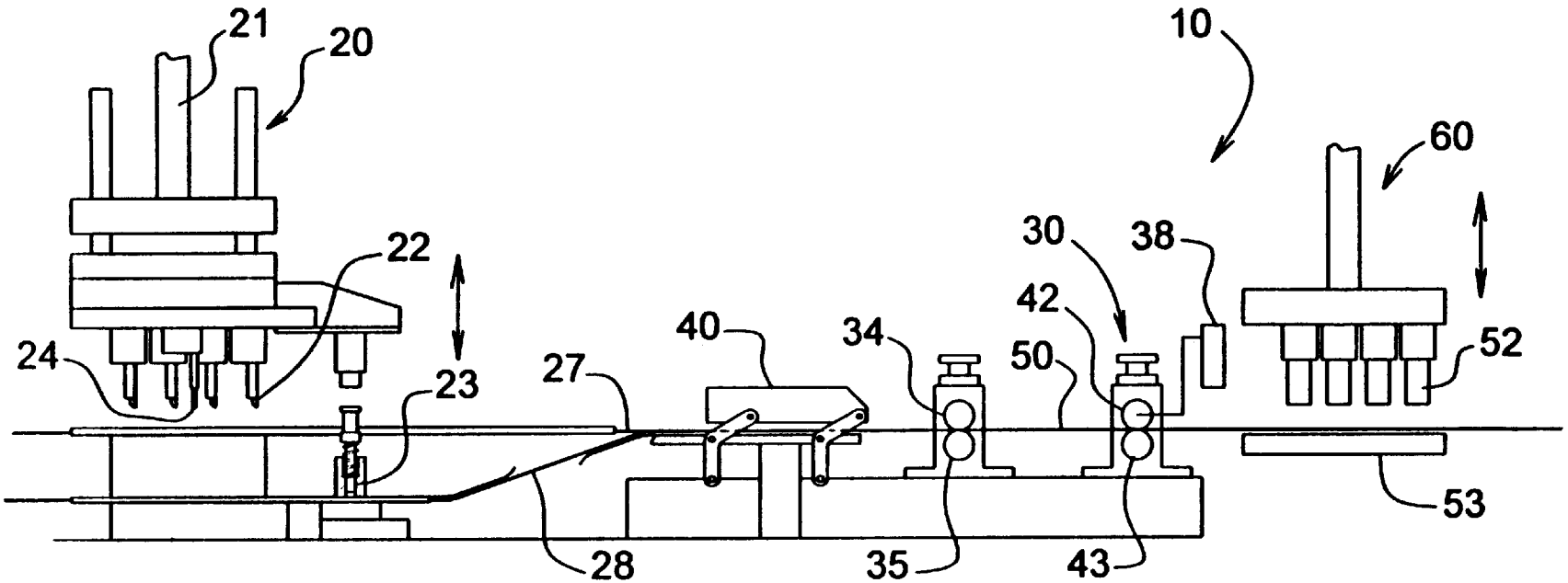
FIG. 1 is a schematic side view of the apparatus for formation of a preformed bonded pull tab over a reseal liner of the present invention.

With reference to FIG. 1 there is shown an apparatus 10 for manufacturing a preformed bonded pull tab seal over a reseal liner. The apparatus 10 is comprised of a tab forming punch press 20 which acts upon a pull tab web 27 passing therebelow. Tab forming punches 22 are reciprocally actuated by punch press 20 and are diagonally aligned along the width of pull tab web 27. Tab forming anvils 22 form one or more pull tabs (in this embodiment four) upon each actuation of reciprocating shaft 21. The pull tab web 27 is aligned for further processing after formation of pull tabs 26 by registration hole punch press 24 which forms registration holes 25, shown in FIG. 2, in the pull tab web 27. Registration holes 25, positioned along the edge of web 27, are formed in web 27 by the same reciprocating drive system 21 that activates tab forming anvils 22 which forms pull tabs 26 in liner web 27. Corresponding registration holes 25*a* are also formed in reseal liner 28 by spring punch press 23. Registration holes 25 and 25*a* aligns holes in both webs of material 27 and 28.

Figure 2:
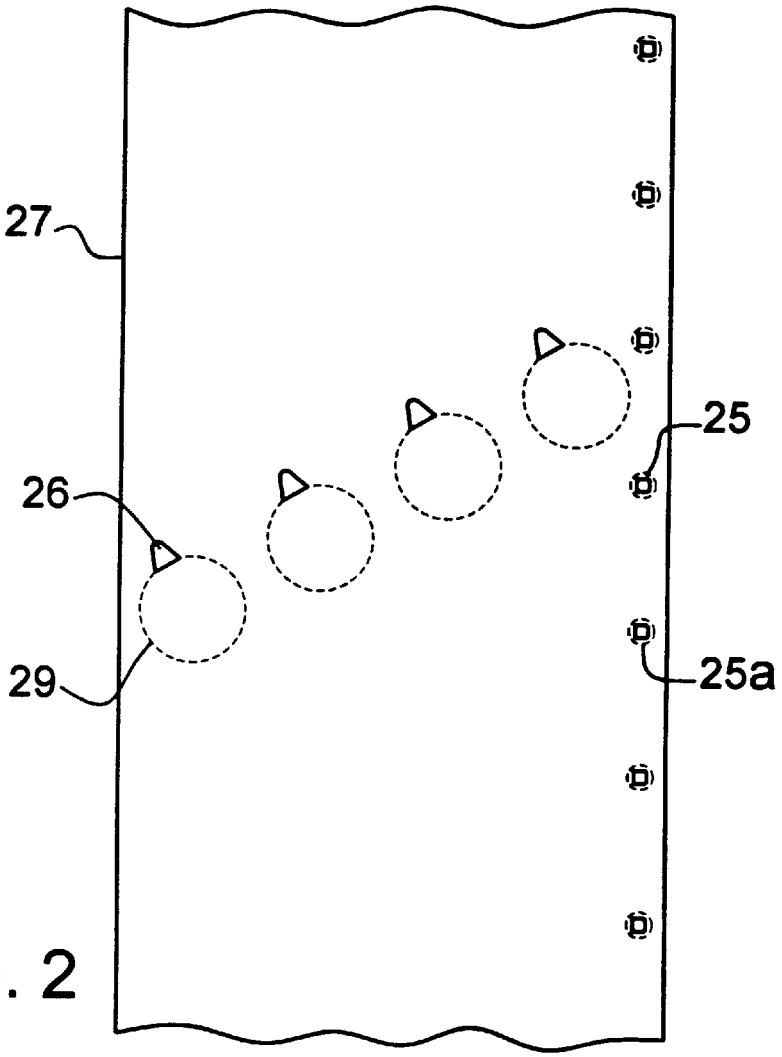
FIG. 2 is a top view of the pull tab liner strip of the present invention.
Figure 4:
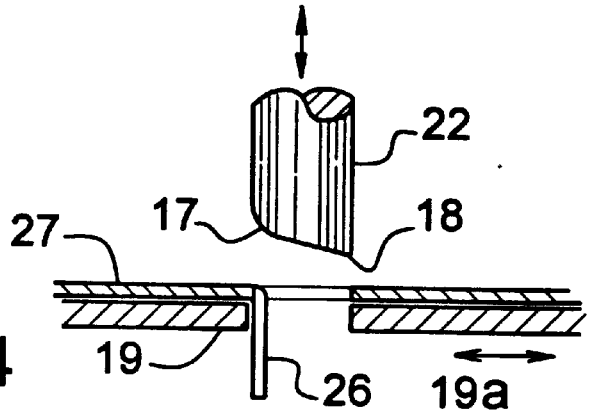
FIG. 4 is a close up side view of the tab forming punches shown in FIG. 1.

Tab forming anvils 22, the diagonal positioning of which is more clearly shown in FIG. 2, create pull tabs 26 along a line diagonally across the width of pull tab web 27 in order to more efficiently utilize the surface area of pull tab web 27. Diagonal formation of the pull tabs 26 is not necessarily required and therefore any positioning of the pull tabs for subsequent processing can be considered with related loss of efficiency of usage for foil web 27. As shown in FIG. 2, pull tabs 26 are formed on the peripheral edge of the eventual pull tab seal 29, the position of which is shown in phantom. Registration holes 25 and 25*a* in both webs 27 and 28 insure that pull tabs 26 are properly formed such that subsequent processing, cutting and formation of the bonded pull tab over reseal liner 50 which is placed into the closure 56, shown in FIG. 5, occurs. Pull tabs 26 are formed prior to joining of the pull tab web 27 and the wax paperboard reseal liner 28, shown in FIG. 1. After formation of the pull tabs 26 by the tab forming punches 22, shown in FIG. 4, tab forming die 19*a* reciprocates to individually fold the pull tabs along the underside of pull tab web 27. This allows the pull tabs 26 to be folded backwards such that it is compressed between the two layers of material 27, 28 inserted into a closure after they are combined. Reseal layer web 28 acts as a reseal liner in the closure for adequate sealing of the container by acting like a gasket in the closure. Therefore, after combination of layers 27, 28, insertion of the pull tab over reseal liner 50 into a closure, bonding of the pull tab seal to the container rim and separation of the two layers of material, the pull tab 26 of seal 29 is upwardly extending and easily accessible by the user as shown in FIG. 6. Die 19*a* actuates sufficiently to cause the pull tab 26 to be folded backwards along the underside of pull tab seal 29 as shown in FIG. 4 such that continued forward motion of the pull tab web 27 causes full backward folding of the tab 26.

Registration holes 25*a* in the paperboard reseal liner web 28 are formed by a separate punch die 23 which is spring actuated as shown in FIG. 1. The resulting holes 25*a* in paper board web 28 are larger than the registration holes 25 in the pull tab web 27 to allow proper mating of the two material webs. Alternatively the index holes in both webs could be formed by the same punch die 24 or similarly, the paper board web 28 can be narrower than the pull tab web 27 to not cover the index holes 25 located thereon. In this embodiment however, for precise locations of subsequent punching operations, both webs are provided with alignment or registration holes 25 and 25*a*.

Figure 3:
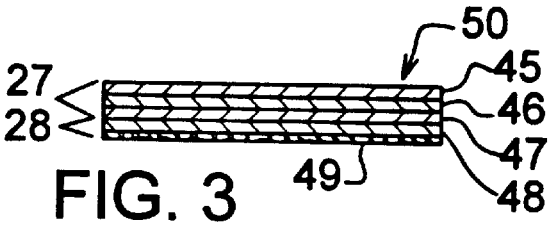
FIG. 3 is a sectional side view of the completed container liner seal of FIG. 1 which is punch-pressed into a closure.
Figure 3A:
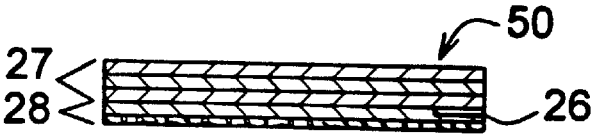
FIG. 3A is a sectional side view of FIG. 3 showing the pull tab formed between the pull tab seal and the reseal liner adhered to the closure.

Turning to FIG. 3A, the bonded pull tab over a reseal liner 50 which is comprised of the pull tab web 27 and wax & paper board web 28 are shown subsequent to bonding. Alternatively, other materials such as plastic foam with an absorbent layer and foil or foam may be used. The pull tabs 26, formed by pull tab punches 22, are folded under the pull tab web 27 and compressed between pull tab web 27 and reseal liner web 28. As displayed in FIG. 3A, the layer of the pull tab seal web 27 is adhered to the rim of the container mouth and the layer of the reseal liner web 28 is sealed to the top wall of the closure 56. Pull tab 26, after combining the two layers 27 and 28 of material, insertion into a closure and subsequent separation by bonding of pull tab seal 29 to a container, may be upwardly exposed as is shown in FIG. 6 in order to provide access to the formed pull tab seal 29 or may be lying flat against the top surface of seal 29 at which point it is merely raised up and removed by upward force.

Turning to FIG. 3, pull tab web 27 is comprised of three layers of material. The top most layer of material joining to form pull tab web 27 is a layer of bottle compatible plastic 45 which is used to join the surface of the formed pull tab seal 29 to the container or mouth rim of the container 51. Directly below the bottle compatible plastic layer 45 is a layer of MYLAR® 46 or other bidirectionally strengthened material which forms a substantial portion of the formed pull tab seal 29, shown in FIG. 2 and FIG. 6. This bidirectionally strengthened material 46 insures that upon application of a removal force on pull tab 26, the formed pull tab seal 29 does not tear or rip. Thus, with an upward force applied to pull tab 26, the entire pull tab seal 29 is removed from the mouth of container 51 separating the melted plastic layer 45 from bottle 51. The MYLAR layer 46 can alternatively be replaced with a paper based material to form a frangible liner that readily tears rather than removing the liner in a single piece as is suggested in this embodiment. Finally, foil layer 47 is combined in the liner material 50 as a portion of web 27 to transfer heat evenly across the pull tab seal 29 and melt the plastic layer 45 when bonding to the container 51. This is accomplished through induction heating wherein the resistance of the foil layer 47 caused by an induction field creates sufficient heat to cause the plastic layer 45 to melt and bond with the container 51.

Figure 7:
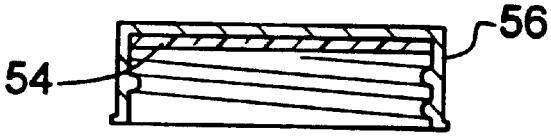

In conjunction with the pull tab web 27, a mating web of material comprising wax and paperboard 28 is utilized in combination to provide the formed closure reseal liner 54 shown in FIG. 7. Wax paperboard 28 is comprised of a pulp or other paper material 49 above which is a layer of wax material 48 shown in FIG. 3. These materials comprise the paperboard web 28. Above the wax material 48 after joining of the two distinct web layers 27 and 28 is aluminum foil 47 or other metallic structure for the welding step of the pull tab liner 29 to the container. The foil 47 is formed as a part of the pull tab membrane 27 separate from paperboard 28. As a result, as shown in FIG. 3, the combined bonded pull tab over reseal liner 50 after joining of the wax paperboard material 28 and the pull tab web 27, is comprised of multiple layers, being: a bottle compatible plastic 45; MYLAR or bidirectionally strengthened material 46; aluminum foil or other metallic structure 47; wax 48; and, pulp or paperboard 49. Below the wax paperboard 49 and immediately prior to insertion into a closure 56, a glue or other adhesive is applied to the bottom surface of paperboard 49 for adhesion of the reseal liner 54 into the closure 56. Alternatively, no glue may be needed to hold the liner disc in the closure. The liner may be snap fit into the closure if during assembly the reseal liner disc 56 is forced past the threads of the closure such that it is held in place by friction and the diameter of the reseal liner disc 56 is slightly larger than the closure opening (See FIG. 7).

As seen by the schematic outline of FIG. 1, after formation of pull tabs 26 in the pull tab web 27, pull tab 26 is compressed between the two layers consisting of pull tab web 27 and paperboard web 28 before insertion into a closure 56, as shown in FIG. 3A. Ultimately after induction welding of the bonded pull tab over reseal liner 50, which is inserted in the closure 56, the pull tab seal 29 will be adhered to the rim of container 51 while the reseal liner 54 will be adhered to the interior underside of closure 56. Upon removal of the closure 56 from container 51, pull tab 26 and pull tab seal 29 will be exposed as is shown in FIG. 6.

Examining FIG. 3 again, the topmost layer of material as displayed in the figure is bottle compatible plastic 45. Most containers which the formed pull tab seal 29 is adhered to are comprised of a thermoplastic material and are made through an extrusion or injection molding process. The layer of bottle compatible plastic 45 on the pull tab web 27 allows the formed pull tab seal 29 to be adhered to the container mouth rim after application of an induction field, the resulting heat of which is dispersed along the entire surface of liner 29 by aluminum layer 47. Once the pull tab web 27 is combined with the reseal liner web 28 and the combined web is placed into the interior of a closure 56, the induction field mentioned above is applied to the closure after placement onto the container. Such induction field causes resistance to build in the aluminum 47 foil thereby creating an even layer of heat which melts the bottle compatible plastic layer 45 and adheres the pull tab seal 29 to the container mouth rim.

Returning to FIG. 4, the pull tab rotary punch press 20 is shown with reciprocating tab forming punches 22 and pull tab web 27 which passes therebelow. Pull tab die 19 provides an aperture for anvil 22 to pass therethrough in order to form the pull tabs 26 in the pull tab web 27 as is shown. Tab forming punches 22, shown in FIG. 4, contain pointed or sharpened portions 18 for piercing the pull tab web 27 and an opposite edge 17 which has a reduced curvature such that tab 26 upon formation is not severed by edge 17. Also shown in FIG. 4 is reciprocating punch die posts 19*a* which moves horizontally from left to right as shown in order to fold tabs 26 backwards after cutting. Tab forming punches 22 reciprocates as shown in FIG. 1 and produces one or more tabs, here shown as four pull tab punches in diagonal relationship in order to increase the efficiency and usage of the pull tab web 27. Pull tab 26, folded downward and backwards, is fully folded below web 27 upon forward movement of the web 27.

Returning to the schematic of FIG. 1, after formation of pull tabs 26 in the pull tab web 27 and formation of index holes 25*a* in the pulp board web 28, both webs are pulled through the heating box 40 by the indexing motor drive 30. An additional drive may be provided after formation of the registration holes to help push the web material forward. Upon entry into the radiant heater box 40, pull tab web 27 and wax paperboard 28 are joined or bonded together. Heating box 40 is preferably a radiant heater which provides an increased temperature environment of sufficient heat to evenly melt the wax layer 48 adjacent the foil layer 47 thereby bonding the pull tab web with the closure reseal liner web 28 upon hardening of the wax. Upon exiting the heater box 40 the tab liner and pulp bond webs are forcibly pressed together and cooled by contact with the compression rollers 34, 35 and 43, 41.

As previously indicated, larger registration holes 25*a* are formed in the wax paperboard web 28. Providing these registration holes 25 and 25*a* in both layers of material 27 and 28, insures accurate processing by punch press 60 shown in FIG. 1. Registration holes 25 and 25*a* are optically sensed by optical sensor 58 immediately prior to punch press 60 so that the punch press and particularly the safety seal anvils 52 are properly aligned with the pull tab liner seal locations 29 and the pull tabs 26 which are shown in FIG. 2. These registration holes 25 and 25*a* are sensed by the optical sensor means 58 which is operably connected to the compression rollers 42 and 43 which feeds the formed bonded pull tab over reseal liner 50 into the punch press 60. Optical sensing means 58 may be any of a multiple of known sensors such as photo cells, air gap sensors or metallic proximity sensors.

Figure 5:
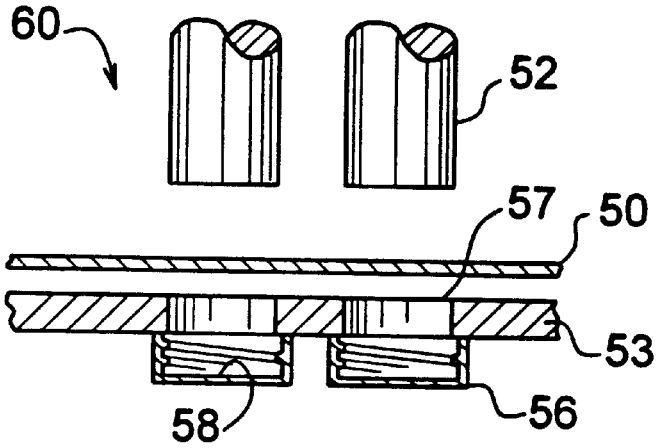
FIG. 5 is a close up of the punch and die shown in FIG. 1 which is utilized to punch the liner material from the liner web into the closures.
Figure 6:
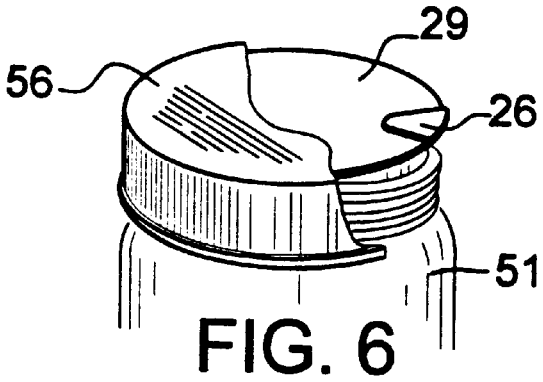
FIG. 6 is a perspective sectional view of fully formed bonded pull tab over a reseal liner manufactured with the method and apparatus of the present invention; and, FIG. 7 is a cutaway side view of the closure of the present invention having a standard reseal liner attached to the top wall.

Referring now to FIG. 5, a close up is shown of the internal mechanisms of punch press 60 which acts to punch pull tab seal 29 and reseal liner 54 from the combined container liner 50 and place the combined punch material into the interior of the closure 56. Below die 53 is placed a closure 56 typically formed of plastic material through an injection, extrusion, or compression molding process. As shown in FIG. 5, the closure 56 utilized in the present embodiment is a threaded closure for screwing onto the neck of a container 51. However, alternate embodiments may incorporate snap fit closures which have a snap fit bead directed inwardly from the closure sidewall in order to hold the closure in place on the container neck.

In FIG. 5, closure safety seal anvil 52 operates in a reciprocating motion puncturing the liner web 50 and inserting the formed container liner 29 with a pull tab 26 formed therebetween and forcing the paper board reseal liner 54, of FIG. 7, into the closure interior. The combined liner strip 50 is guided by the index holes 25 and 25*a* to maintain proper positioning and location within the machinery. Liner web 50 is advanced by stepper motor 30. Motor 30 is operably connected with optical sensor 38 to control the advancement of web 50 for correct placement of the web under the cutting dies. Indexing the liner web 50 is controlled by index holes 25 and 25*a* to provide proper linear advance of the web 50 so that the formed tabs are accurately placed under the punch anvil 52 and opening in the die 53 such that the tabs are formed properly on the edge of each cut liner circle 29 outlined in FIG. 2. The anvils 52 may be placed in a diagonal fashion as is shown in FIG. 2 in order to maximize the usage of the liner web 50 and minimizing any wasting of said material. Optical sensing means 38 thereby controls servo rollers 42 and 43 and placement of the liner web 50 by reading the registration holes 25 and 25*a* so that the anvils cut out a bonded pull tab over reseal liner 51 for insertion into the interior of the closure 56. Additionally, an adhesive material may be placed in the interior top wall 58 of closure 56 such that upon insertion of the liner web 50 after punch press 52 reciprocates through dye 53, the reseal liner 54 adheres to the interior of closure 56.

As shown in FIG. 6, after insertion of the liner material into closure 56, the closure may be threadably attached to a container 51 which, after induction welding or application of heat, can separate pull tab seal 29 from the reseal liner 54 thus exposing the pull tab seal 29 upon first removal of closure 56 from container 51.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. An apparatus for manufacturing a bonded pull tab over a reseal liner, comprising:

a web of reseal liner material;

a web of pull tab seal material;

first tab forming punch press, said web of pull tab seal material positioned below said punch press, said first punch press further having at least one tab forming anvil extending downward therefrom and reciprocating through said web of pull tab seal material and forming at least one pull tab therein, said at least one pull tab being hingedly connected to said web of pull tab seal material, said first tab forming punch press further having a registration hole punch actuating on said web of reseal liner and said web of pull tab seal material;

a folding mechanism to place said at least one pull tab against said web of pull tab seal material;

a radiant heater to bond said web of pull tab seal material and said web of reseal liner material to form a combined web of material such that said at least one pull tab is compressed between said web of pull tab material and said reseal liner material;

a second punch press located down line from said first tab forming punch press along said combined web of material for cutting out of said combined web of material said bonded pull tab over a reseal liner.

2. The apparatus of claim 1 wherein said web of pull tab seal material is comprised of a layer of bidirectionally strengthened material, a layer of thermoplastic material and a layer of aluminum.

3. The apparatus of claim 1 wherein said web of reseal liner material is a paper based material.

4. The apparatus of claim 1 wherein said reseal liner material is comprised of a layer of paperboard and a layer of wax.

5. The apparatus of claim 1 wherein said first tab forming punch press is further comprised of four diagonally spaced tab forming anvils.

6. The apparatus of claim 1 further comprising an optical sensor operably connected to a compression roller, said compression roller contacting said web of reseal liner material and said pull tab seal material along said formed registration holes.

7. An apparatus for manufacturing pull tab inner seal liner for a container, comprising:

an inner seal liner web of material and a wax paperboard web of material;

a first pull tab rotary punch press having a plurality of tab forming anvils;

a conveyance motor to transport said wax paperboard web through said first pull tab rotary punch press;

wherein said first pull tab rotary punch press forms a plurality of pull tabs in said inner liner web of material, said first pull tab rotary punch press further comprising a registration hole punch actuating on said inner seal liner web of material and said wax paperboard web of material;

a radiant heater which receives said inner seal liner web and said wax paperboard web and creates a combined pull tab and reseal liner web;

a second liner punch press which receives said combined pull tab and reseal liner web and having a plurality of reciprocating safety seal anvils thereon;

wherein said second liner punch press punches out a plurality of closure pull tab and reseal liners from said combined pull tab and reseal liner web.

8. An apparatus for manufacturing a plurality of bonded pull tab over a reseal liners for closures, comprising:

a pull tab seal web of material and a reseal liner web of material;

a first tab forming punch press having a plurality of tab forming anvils thereon, said anvils forming a plurality of pull tabs in said pull tab seal web of material, said first tab forming punch press folding said plurality of pull tabs against said pull tab web of material;

said first tab forming punch press including actuating a registration hole punch on said web of reseal liner and said web of pull tab seal material to form registration holes for further alignment;

a conveyance motor for transporting said pull tab seal web through said first tab forming punch press;

a radiant heater to combine said pull tab seal web and said reseal liner web such that said pull tabs are compressed therebetween and form a bonded pull tab over a reseal liner web of material alignment;

a second liner punch press having a plurality of reciprocating safety seal anvils to punch out from said bonded pull tab over a reseal liner web of material said plurality of bonded pull tab over a reseal liners into said closures.

* * * * *